US005188083A

United States Patent [19]

Reisser et al.

[11] Patent Number: 5,188,083

[45] Date of Patent: Feb. 23, 1993

[54] FUEL INJECTION PUMP FOR INTERNAL COMBUSTION ENGINES

[75] Inventors: Berni Reisser, Notzingen; Hannes Pflug, Weilderstadt; Mohammad-Ali Khosrawi, Ludwigsburg; Michael Scharf, Brunswick; Helmut Simon, Goeppingen; Christian Taudt, Winnenden-Schelmenholz; Wolfgang Goll, Ilsfeld; Paul Wuetherich, Schwieberdingen; Thomas Fortenbacher, Gerlingen; Karl Konrath, Freiberg/Neckar, all of Fed. Rep. of Germany

[73] Assignee: Robert Bosch GmbH, Stuttgart, Fed. Rep. of Germany

[21] Appl. No.: 890,427

[22] Filed: May 29, 1992

[30] Foreign Application Priority Data

May 31, 1991 [DE] Fed. Rep. of Germany ..... 4117813

[51] Int. Cl.[5] ..... F02M 37/04

[52] U.S. Cl. ..... 123/502; 123/449

[58] Field of Search ..... 123/502, 449, 503, 179.17

[56] References Cited

U.S. PATENT DOCUMENTS 3,101,078 8/1963 Evans ..... 123/502
3,147,746 9/1964 Hofer ..... 123/502
4,353,343 10/1982 Trachte ..... 123/502
4,368,709 1/1983 Yasuhara ..... 123/502
4,430,974 2/1984 Bofinger ..... 123/502
4,475,521 10/1984 Greiner ..... 123/502
4,502,449 3/1985 Laufer ..... 123/502
4,619,238 10/1986 Hain ..... 123/502
4,622,943 11/1986 Braun ..... 123/502
4,733,645 3/1988 Hain ..... 123/502
5,085,196 2/1992 Hain .

*Primary Examiner*—Carl S. Miller
*Attorney, Agent, or Firm*—Edwin E. Greigg; Ronald E. Greigg

[57] ABSTRACT

The invention is based on a fuel injection pump in which to supply a very rapid pressure rise in the interior of a fuel injection pump, a pressure valve controlling this pressure is modified such that upon cold starting of the engine, the pressure valve closes a bypass line at the feed pump and thus delivers all the fuel to the fuel injection pump. The closure is effected as a function of rpm and accordingly pressure, and also as a function of the engine operating temperature; in the fuel injection pump according to the invention, the rpm- and pressure-dependent diversion is performed by the adjusting piston of an injection adjuster. Thus, compared with the known cold-starting accelerating devices, one additional pressure limiting valve can be eliminated.

1 Claim, 1 Drawing Sheet

FUEL INJECTION PUMP FOR INTERNAL COMBUSTION ENGINES

BACKGROUND OF THE INVENTION

The invention is based on a fuel injection pump as defined hereinafter. A pump of this kind is known from German Patent Application DE-OS 39 12 624, U.S. Pat. No. 5,085,196. There, a diversion by the feed pump is prevented via hydraulically locking the feed pump pressure control valve, so that all the fuel fed is used to build up the control pressure. In this way, even when the engine is cold, a high suction chamber pressure and the associated adjustment of injection toward "early" can be attained as fast as possible. The known cold starting system comprises a fuel injection pump having an injection adjuster, a feed pump by way of which a pressure control valve, located in the incoming line to the fuel injection pump, controls the inflow to the suction chamber, and two valves disposed parallel in the relief line of the pressure control valve restoring chamber, one of which valves is opened as a function of the engine operating temperature, and the other of which is opened as a function of the control pressure in the suction chamber. In the warmup phase or upon engine starting, these two valves in the relief line of the pressure control restoring chamber make possible a diversion of the fuel inflow by hydraulically blocking the bypass line via the pressure control valve, so that all the fuel flows to the fuel injection pump, and in a known manner can rapidly build up the control pressure, which results in an adjustment of the injection adjuster toward "early". This special adjustment toward "early" is cancelled when a certain pressure and the associated opening of the pressure valve is attained or at the end of the warmup phase by opening of the pressure holding valve; the relief line of the restoring chamber of the pressure control valve is thereupon opened. After that, the pressure acting upon the injection adjuster is controlled in a known manner as a function of rpm by the pressure control valve. The adjustment toward "early" improves the cold starting performance and the operation of the engine in the warmup phase. A disadvantageous feature of the known apparatus is the complicated additional disposition of the pressure valves in the relief line of the feed pump pressure control valve, which requires additional space and is therefore more expensive. This is why there is a need for a simplified structure of the entire cold starting device for an internal combustion engine.

OBJECT AND SUMMARY OF THE INVENTION

The fuel injection pump according to the invention has an advantage over the prior art that the position of the adjusting piston of the injection adjuster is used as an rpm-proportional signal, to control the blocking of the relief line of the pressure control valve. As a result, a separate pressure-controlled valve can be eliminated, which has considerable cost advantages in production of the fuel injection pump. Moreover, the tolerances of the injection adjustment position at the transition from the cold starting acceleration to the normal function can be kept small. Other advantages and advantageous features of the invention can be found in the ensuing description, drawing and claims.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
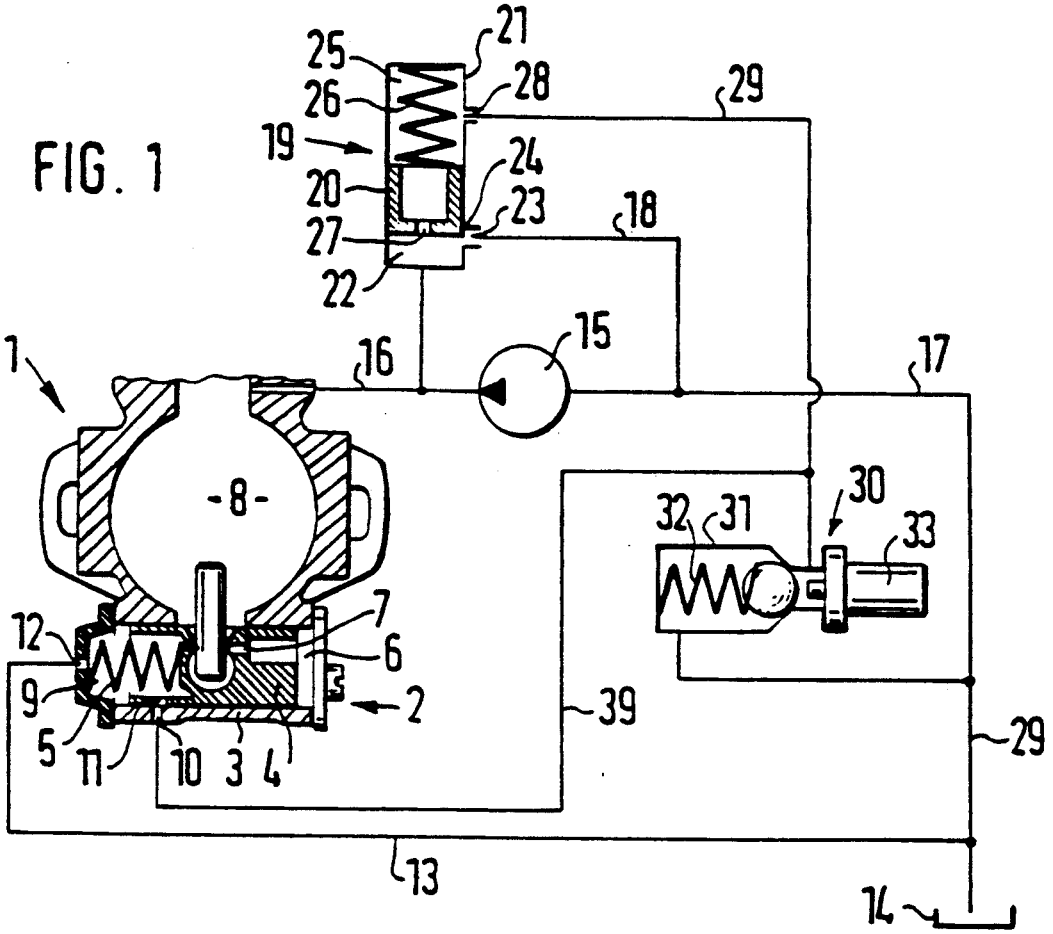
FIG. 1 schematically shows the fuel injection pump of the invention.

In FIG. 1, part of a distributor-type fuel injection pump 1 is shown, with an injection adjuster 2 that has an adjusting piston 4 that is displaceable in a cylinder 3 and is acted upon on one face end by a restoring spring 5 which is supported in stationary fashion on one face end of the cylinder 3 and is located in a restoring chamber 9 that is defined by one face end and the wall of the cylinder 4 and by one face end of the injection adjuster piston 4, on the other face end of which an injection adjuster work chamber 6 is defined in the cylinder 3. The injection adjuster work chamber 6 communicates via a throttle bore 7 in the injection adjuster piston 4 with a suction chamber 8 in the interior of the fuel injection pump. In the region of the restoring chamber 9, the cylinder 3 has an inlet bore 10 on its cylindrical wall, which bore is opened or closed during the axial motion of the injection adjuster piston 4 in the cylinder 3 via a control edge 11, formed by a bore in the injection adjusting piston 4 that communicates continuously with the restoring chamber. In addition, via the face end of the cylinder 3, a relief bore 12 discharges into the restoring chamber 9 of the injection adjuster 2, so that the restoring chamber is continuously pressure-relieved via a return line 13 to the fuel tank 14. The suction chamber 8 is supplied with fuel by a feed pump 15, driven in synchronism with the distributor-type fuel injection pump 1, via a pressure line 16; the feed pump 15 draws the fuel from the fuel tank 14 via an intake line 17. Parallel to the feed pump 15, there is a bypass line 18 in which a pressure control valve 19 is located. This valve has an adjustable wall, in the form of a control piston 20 that slides tightly in a cylinder 21, and which on one face end defines a pressure chamber 22 into which the bypass line 18 discharges from the pressure line 16. On the other face end, the control piston 20 defines a restoring chamber 25, in which a restoring spring 26 is disposed that is supported on one end on the control piston 20 and at the other on the upper face end of the cylinder 21. An outflow connection 23 of the pressure chamber 22 is also let into the cylindrical wall of the cylinder 21; its cross section is opened or closed by a control edge 24, formed by the bottom of the control piston 20, depending on the axial position of the control piston 20. This outflow line 23 discharges back into the intake line 17 to the feed pump 15, via the bypass line 18'. The restoring chamber 25 communicates continuously with the pressure chamber 22 via a throttle 27. The restoring chamber 25 also communicates with the fuel tank 14 via a relief line 29. A pressure holding valve 30 that is capable of blocking the outflow out of the restoring chamber 25 is disposed in this relief line 29. This pressure holding valve 30 is embodied as a check valve and is closed by a ball valve 31 with a spring element 32; the closing element may be pushed open by a final control element 33 actuated as a function of temperature. This final control element 33 is for example a thermostat or an expandable material element that is exposed to the engine coolant and thus detects the engine operating temperature. Accordingly, when the engine is at operational temperature, the closing element is pushed open by the final control element 33 counter to the spring force of the ball valve 31, and thus the relief line 29 is open toward the fuel tank 14. Parallel to the pressure holding valve 30, a relief line 39 leads to the inlet bore 10 into the cylinder 3 of the injection adjuster 2; beyond a certain axial position, an opening cross section is uncovered by the injection adjusting piston 4, and the fuel can flow out of the restoring chamber 25 of the pressure control valve 19 to the fuel tank 14 via the restoring chamber 9 of the injection adjuster 2. During operation of the fuel injection pump, its suction chamber is filled with fuel. Since the same pressure prevails in the pressure chamber 22 and the restoring chamber 25 of the pressure valve 19, the restoring spring 26 adjusts the control piston 20 toward the bottom of the cylinder 21 of the pressure control valve 19 and thus closes the outflow connection 23. The adjusting piston 4 is also correspondingly kept in its outset position by the restoring spring 5, and with its periphery it closes off the inlet bore 10. Upon starting, the feed pump 15 is set into motion, and it generates a pressure in the suction chamber 8 and accordingly in the pressure chamber 22 of the pressure control valve 19. Since the relief of the restoring chamber 25 is blocked while the engine is still cold by the pressure control valve 19 via the pressure holding valve 30 and the injection adjuster 2, the control piston 20 is kept in its outset position, and the bypass line 18 remains closed. As a result, all the fuel pumped flows into the suction chamber 8 of the distributor-type fuel injection pump 1, so that an effective control pressure can build up there very quickly. This rapid rise in pressure in the suction chamber 8 also brings about a rapid pressure rise via the throttle bore 7 in the injection adjuster work chamber 6, where via an axial motion of the adjusting piston 4 an adjustment of the injection onset toward "early" then occurs. As the engine rpm rises and thus as the rpm of the distributor-type fuel injection pump rises, the suction chamber pressure increases further, until the position of the control edge 11 of the adjusting piston 4 uncovers the inlet bore 10 of the relief line 29 of the restoring chamber 25 of the control valve 19. The relief line is then no longer blocked; the fuel from the restoring chamber 25 can flow out via the restoring chamber 9 of the injection adjuster 2, resulting in an immediate pressure drop in the restoring chamber 25 of the pressure control valve 19. The pressure generated by the feed pump 15 in the pressure chamber 22 is now sufficient to move the control piston 20 counter to the spring force of the restoring spring 26 and thus to uncover the outflow line 23 via the control edge 24 on the control piston 20. Since some of the fuel pumped now flows out via the bypass line 18 of the pressure control valve 19, breakaway control of the steep pressure rise in the suction chamber 8 occurs, with the associated adjustment of the injection adjuster 2 toward "early". Upon a further increase in rpm, a course of the control pressure that increases with the rpm takes place, because now the restoring chamber 25 of the pressure control valve 19 is relieved, and the pressure control valve 19 now controls the pressure in the suction chamber 8 of the function of rpm, by variably widely opening the outflow throttle 23. The pressure holding valve 30 will likewise open as a function of temperature, at a certain engine operating temperature. The task of this valve in the relief line 29 of the restoring chamber 25 of the pressure control valve 19 is to terminate the extreme adjustment toward "early" of the injection adjuster 2 once the operating temperature is attained, and when the warm engine is started to avoid an early injection onset, with its associated high emissions of pollutants. This is attained in that even with the engine shut off and the associated fuel pressure drop, the temperature-dependent final control element 33 keeps the pressure holding valve 30 opened when the coolant is hot, and thus assures the continuous relief of the restoring chamber 25 in the pressure control valve 19. If the engine is then started, the pressure regulation and thus the injection adjustment take place immediately as a function of rpm, via the pressure control valve 19. The device according to the invention thus enables the extreme injection adjustment, up to an extent limited by the adjusting piston of the injection adjuster, only when the engine is cold. In this way, the advantage of a pronounced adjustment toward "early" when the engine is cold does not disadvantageously affect starting when the engine is at operating temperature. The advantage of the fuel injection pump according to the invention that should be stressed is the elimination of a pressure valve in the relief line 29 of the pressure control valve 19, because the rpm-dependent control during the engine warmup phase is effected via the adjusting piston 4 of the injection adjuster 2 of the distributor-type fuel injection pump 1.

Figure 2:
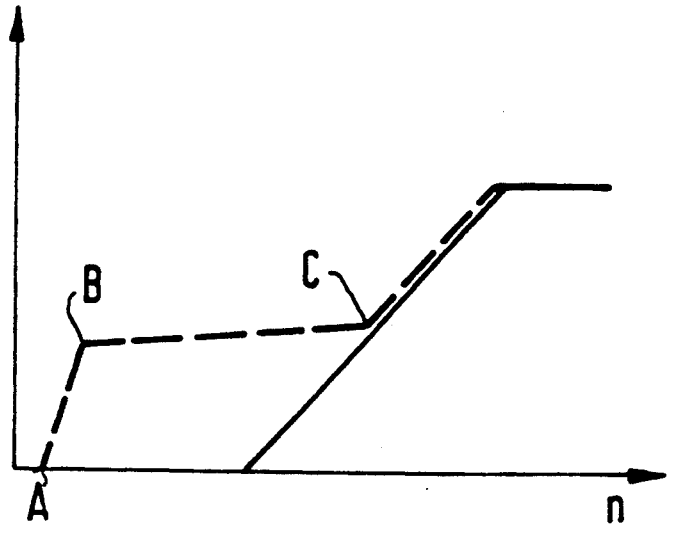
FIG. 2 shows the course of pressure in the pressure chamber of the pressure control valve and of the control pressure operative at the injection adjuster, at various functional positions of the adjusting piston.

In FIG. 2, the course of the injection adjustment is shown in a diagram, plotted over the rpm. The dashed line represents the fuel injection pump according to the invention, compared with the solid line for a distributor-type fuel injection pump lacking a cold-starting accelerator. Once the engine has started, the rapid pressure buildup in the suction chamber and the associated steep rise in the injection onset can be seen (point A to point B). At point B, upon the attainment of a certain adjustment toward "early" and the associated adjustment of the adjusting piston of the injection adjuster, the opening of the relief line 29 in the restoring chamber 25 of the pressure control valve 19 and the associated breakaway control, already described, of the fuel inflow to the suction chamber 8 of the distributor-type fuel injection pump 1 take place. From that rpm point on until the attainment of the rpm corresponding to point C, the pressure in the suction chamber remains the same or rises only slightly. From the rpm point C on, the pressure control valve 19 takes over the usual rpm-dependent control of the control pressure and hence the control of the injection onset of the fuel injection pump.

The foregoing relates to a preferred exemplary embodiment of the invention, it being understood that other variants and embodiments thereof are possible within the spirit and scope of the invention, the latter being defined by the appended claim.

What is claimed and desired to be secured by letters patent of the United States is:

1. A fuel injection pump for internal combustion engines, having an injection adjuster (2) that has an adjusting piston (4) that is displaceable in a cylinder (3), said adjusting piston on one face end encloses a work chamber (6), exposed to a control pressure controlled as a function of rpm, in the cylinder (3) and on the other face end defines a restoring chamber (9), which contains a spring (5) acting upon the adjusting piston (4) with a restoring force, and which chamber is relieved via a return line (13); to a fuel tank a feed pump (15) driven in synchronism with the fuel injection pump, the feed pressure of said feed pump is controlled as a control pressure by a pressure control valve (19), which has a wall, acted upon by the control pressure, said wall is adjustable counter to a restoring spring (26), the adjustable wall divides a pressure chamber (22) from a restoring chamber (25) that receives the restoring spring (26) and communicates continuously with the pressure chamber (22) via a throttle bore (27), whereupon with the control motion of the adjustable wall in the pressure control valve (19), an outflow line (23) from the pressure chamber (22) to a relief chamber is controlled and the restoring chamber (25) is relieved via a pressure holding valve (30) with temperature-dependent actuation and via a pressure limiting valve, said pressure limiting valve has a control piston acted upon by the control pressure and is adjustable counter to a restoring spring, by means of said control piston, the flow cross section of a relief line communicating with the restoring chamber is controllable, acting as the control piston of the pressure limiting valve for the relief of the pressure control valve restoring chamber (25) of the feed pump (15) is an adjusting piston (4) of the injection adjuster (2), said adjusting piston has a control opening on a jacket face, the opening being defined by a control edge and communicating with the restoring chamber (9), said control opening communicates with the relief line (29) of the restoring chamber (25) beyond a predetermined displacement position of the adjusting piston which discharges into the cylinder (3).

* * * * *